US009574840B1

(12) United States Patent
Sisk

(10) Patent No.: US 9,574,840 B1
(45) Date of Patent: Feb. 21, 2017

(54) HANDGUARD EXTENDING PICATINNY RAIL MOUNT

(71) Applicant: Charles H. Sisk, Dayton, TX (US)

(72) Inventor: Charles H. Sisk, Dayton, TX (US)

( * ) Notice: Subject to any disclaimer, the term of this patent is extended or adjusted under 35 U.S.C. 154(b) by 0 days.

(21) Appl. No.: 14/756,588

(22) Filed: Sep. 21, 2015

(51) Int. Cl.
*F41A 35/00* (2006.01)

(52) U.S. Cl.
CPC ..... *F41A 35/00* (2013.01)

(58) Field of Classification Search
CPC ..... F41A 35/00; F41A 11/02; F41C 23/16; F41C 27/00; F41G 11/003
USPC ..... 42/75.02, 75.03; D22/108, 109, 110
See application file for complete search history.

(56) References Cited

U.S. PATENT DOCUMENTS 3,445,951 A * 5/1969 Dahl ..... F41C 23/16 42/49.01
6,526,684 B1 * 3/2003 Hickerson ..... F41A 17/44 42/70.01
7,559,167 B1 * 7/2009 Moody ..... F41G 11/003 42/71.01
7,568,304 B1 * 8/2009 Moody ..... F41A 23/08 42/71.01
D609,770 S * 2/2010 Mulfinger ..... D22/110
7,861,452 B2 1/2011 Moody et al.
7,909,301 B2 3/2011 Faifer
8,028,458 B2 * 10/2011 Rohrauer ..... F41A 3/66 42/75.01
8,109,032 B2 2/2012 Faifer
8,176,669 B1 5/2012 Griffin
8,371,056 B1 * 2/2013 Baker ..... F41G 11/003 42/106
8,393,104 B1 * 3/2013 Moody ..... F41C 23/14 42/71.01
D684,647 S 6/2013 Trusty
8,510,983 B2 8/2013 Larue
8,904,691 B1 * 12/2014 Kincel ..... F41C 23/16 42/71.01
2004/0000083 A1 * 1/2004 Grant, Jr. ..... F41G 11/003 42/112
2004/0103577 A1 * 6/2004 Compton ..... F41G 11/003 42/85
2011/0016762 A1 1/2011 Davies
2012/0218741 A1 * 8/2012 Christiansen ..... F41G 11/003 362/110

(Continued)

OTHER PUBLICATIONS

AR15NEWS, Samson Evolution Rail System, Dec. 23, 2010, http://www.ar15news.com/2010/12/23/new-ar-15-accessory-samson-evolution-rail-system/.*

*Primary Examiner* — Joshua Freeman
(74) *Attorney, Agent, or Firm* — Gordon K. Anderson

(57) ABSTRACT

A mount is taught which incorporates a Picatinny rail and a handguard interface. The mount has an offset L-shape which includes an integral Picatinny rail portion for accessory mounting and an integral threaded handguard adapter portion that attaches to an existing firearm handguard. The mount has a body with the handguard adapter portion protruding outwardly on a front side, a body vertical leg and the Picatinny rail formed integrally on the bottom of a body horizontal leg. The handguard adapter has a hollow inside diameter adapted to conform to a handguard interface surface and a lockring is provided for manual adjustment of the handguard. A second embodiment omits the legs and incorporates an offset shape.

17 Claims, 4 Drawing Sheets

(56) References Cited

U.S. PATENT DOCUMENTS

| | | | | |
|---|---|---|---|---|
| 2013/0118051 | A1* | 5/2013 | Baker | F41G 11/003 42/90 |
| 2014/0026459 | A1* | 1/2014 | Yan | F41C 23/16 42/71.01 |
| 2014/0360077 | A1 | 12/2014 | Miller et al. | |
| 2015/0168095 | A1* | 6/2015 | Dubreuil | F41C 23/16 42/90 |

* cited by examiner

HANDGUARD EXTENDING PICATINNY RAIL MOUNT

CROSS REFERENCE TO RELATED APPLICATION

This application claims priority of Provisional Patent Application Ser. No. 62/123,521 filed Nov. 20, 2014.

TECHNICAL FIELD

The present invention relates to an integral offset shaped support mount for connection to a firearm handguard interface for extending an integral Picatinny rail.

BACKGROUND ART

Previously, many types of Picatinny rails have been used in endeavoring to provide an effective means for attaching accessories to a firearm.

The prior art listed below did not disclose patents that possess any of the novelty of the instant invention; however the following U.S. patents are considered somewhat related:

| Pat. No. | Inventor | Issue Date |
|---|---|---|
| 7,861,452 B2 | Moody et al. | Jan. 4, 2011 |
| 7,909,301 B2 | Faifer | Mar. 22, 2011 |
| 8,109,032 B2 | Faifer | Feb. 7, 2012 |
| 8,176,669 B1 | Griffin | May 15, 2012 |
| D684,647 S | Trusty | Jun. 18, 2013 |
| 8,510,983 B2 | Larue | Aug. 20, 2013 |
| 2011/0016762 A1 | Davies | Jan. 27, 2011 |
| 2014/0360077 A1 | Miller et al. | Dec. 11, 2014 |

U.S. Pat. Nos. 7,861,452 B2, 7,909,301 B2, 8,109,032 B2 and 8,510,983 B2 all teach some type of an accessory for attachment onto a Picatinny Rail.

Patent Applicant Publication No. 2014/0360077 A1 issued to Miller et al. provides conductive elements positioned into channels of quad tactile rails to distribute battery electrical power directly to attached accessories.

Davies in U.S. Patent Applicant Publication No. 2011/0016762 A1 discloses a handguard system for use on a rifle having a barrel and a receiver. The tubular handguard covers the barrel and engages a barrel nut.

U.S. Pat. No. 8,176,669 B1 issued to Griffin is for a rail accessory mount that comprises actuatable jaw segments and a base. The segments are drawn together at a base collar which includes a Picatinny rail accessory receiving fixture which incorporates indentations for mating with an existing weapon handguard.

For background purposes and as indicative of the art to which the invention is related reference may be made to the remaining cited patent No. D684,647 S issued to Trusty.

DISCLOSURE OF THE INVENTION

There has been a long felt need for firearms having a free floating handguard to increase their utility by adding a forward facing accessory rail. This rail is the Picatinny style, which has been used throughout this country for mounting a myriad of accessories.

It is therefore the primary object of the invention to have a mount that requires only a threaded handguard interface for attachment of a rail without the necessity to modify the firearm in any manner. Further the mount may be configured to fit any "tactile rifle or pistol" having a free floating handguard particularly the AR-15 type that utilize a low profile gas block in place of the military standard integral front sight and handguard front socket.

An important aspect of the invention is that the rail may be utilized as a mounting platform for a bipod, a telescope sight, a flashlight, a laser sight, a diode reflex sight, a sling swivel and other well known useful accessories.

Another attribute of the invention is in the angular offset shape which may be rotated 360 degrees placing the rail on the bottom, top or either side and tighten the lockring. Further the rail may be positioned axially 360 degrees to achieve the most optimum shooters position.

Still another feature of the invention the lockring allows the rail be rotated in the field by grasping the finger tab and loosen the connection revolving the mount to the desired position and locking the rail in place This feature is extremely important if the rail is used to mount a bipod and the shooter requires a different angle such as on a hill or sloping ground to keep the sighting arrangement in the most advantageous position.

Yet another feature of the invention is the ability to install the mount by manually screwing the mount into the existing handguard female threads with the male threads of the mount without any tools.

The usefulness of the invention is enhanced as it may be installed fore or aft with the body vertical leg having any height and the rail may be fabricated any length. The threaded interface may be formed outside or inside with any mating diameter according to the configuration of the free floating handguard where it is employed.

A further aspect of the invention is the lightweight feature as the mount is fabricated of aircraft grade aluminum and hard anodized for protection from the elements.

A second embodiment utilizes a smaller body permitting a round billet to be used requiring considerably less waste of material during machining.

A final attribute of the second embodiment of the invention is the mounts body has considerable strength and provides ease of production since it may be fabricated using CNC machine technology.

These and other objects and advantages of the present invention will become apparent from the subsequent detailed description of the preferred embodiment and the appended claims taken in conjunction with the accompanying drawings

BEST MODE FOR CARRYING OUT THE INVENTION

Figure 1:
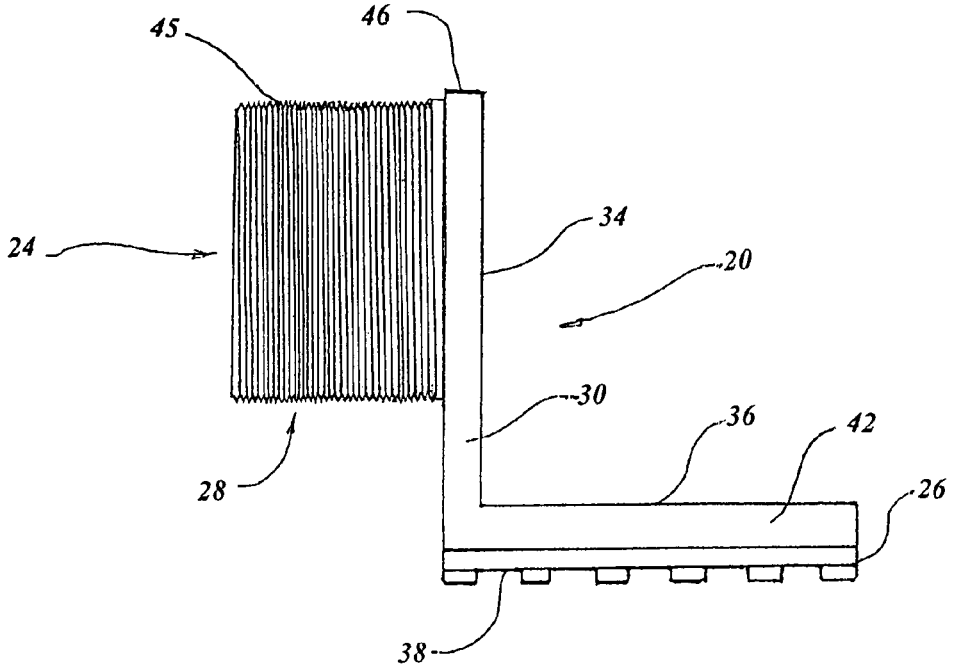
FIG. 1 is a left side view of the mount in the preferred embodiment.
Figure 2:
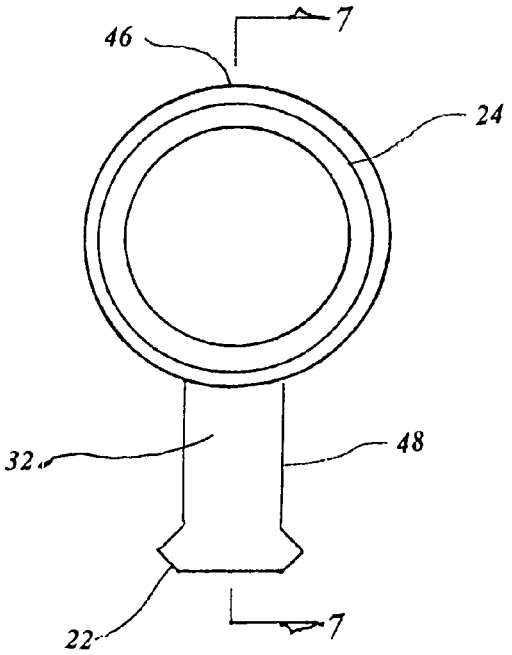
FIG. 2 is a front view of the mount in the preferred embodiment.
Figure 3:
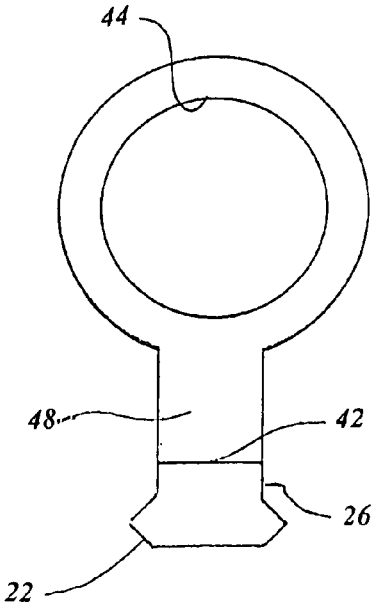
FIG. 3 is rear view of the mount in the preferred embodiment.

The best mode for carrying out the invention is presented in terms of a preferred and a second embodiment. The preferred embodiment is shown in FIGS. 1 thorough 11 which is comprised of mount 20 which incorporates a Picatinny rail 22 and a handguard interface 24. The mount 20 has an offset L-shape which incorporates an integral Picatinny rail portion 26 for accessory mounting, and an integral threaded handguard adapter portion 28. The mount 20 interfaces with a floating handguard on a firearm, such as the AR-15 type, or other similar firearms and types that incorporate similar handguards.

The mount 20, is basically offset in shape as illustrated in FIGS. 1, 4, 7, and 11. The mount 20 includes a body 30 integrally formed with the threaded handguard adapter portion 28 which protrudes outwardly on the front side 32 of the body vertical leg 34. The Picatinny rail portion 26 is formed integrally on the bottom of a body horizontal leg 36.

The body 30, which includes integral threaded handguard adapter portion 28 and the integral Picatinny rail portion 26, consists of aircraft grade aluminum that is hard anodized. The Picatinny rail portion 26 is adapted to conform to Military Standard MIL-STD-1913 and has slots 38 that are spaced 0.394 inches center to center incorporating at least 3 slots 38 in the rail 26. The mount 20 integral Picatinny rail portion 26 is positioned horizontally on the bottom a longitudinal surface 40 of the horizontal leg 36 as shown in FIGS. 1, 3, 6, 7 and 11. The horizontal Picatinny rail portion 26 has a riser 42 on the longitudinal surface 40 with a width of from 0.60 inches to 0.65 inches, depicted best in FIGS. 1, 3, and 4.

Figure 11:
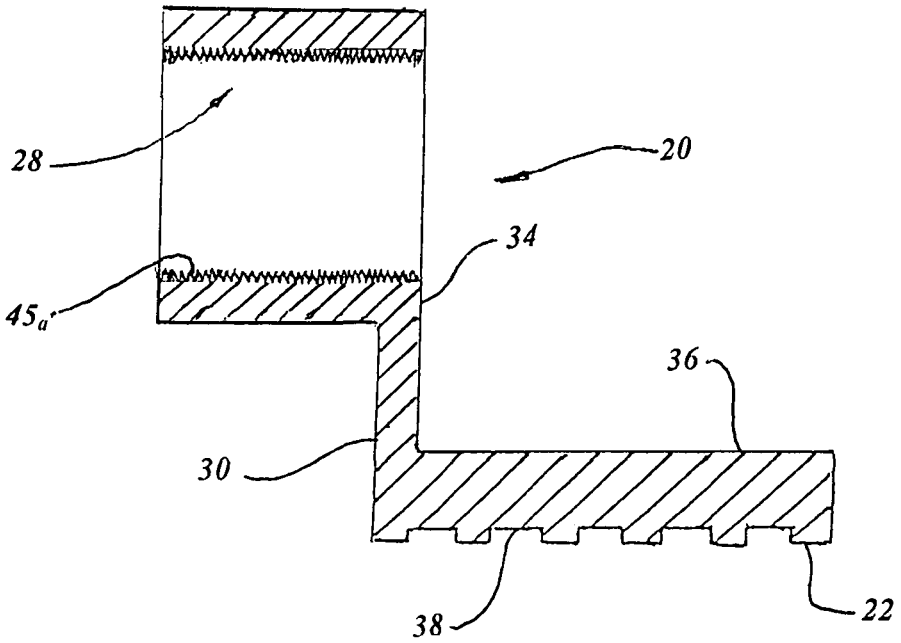
FIG. 11 is a cross sectional view of the mount with internal threads.

The integral threaded handguard adapter portion 28 has a hollow inside diameter 44 adapted to conform to a rifle handguard internal surface and has an outside threaded diameter 45 of from 0.15 inches to 3.00 inches. An alternative embodiment replaces the outside diameter threads 45 with inside diameter threads 45*a*, as illustrated in FIG. 11.

The mount body 30 having the integral threaded handguard adapter portion 28 is positioned on the mount vertical leg 34 near a distal end 46 of the mount body 30, as illustrated in FIGS. 1, 2, and 4-7. The integral threaded handguard adapter portion 28 has a length protruding from the mount body 30 from 0.25 inches to 2.00 inches, and the vertical surface of the mount body 30 has an extending portion 48 from the integral threaded handguard adapter portion 28 to the Picatinny rail portion 26 from 0.25 inches to 6.50 inches.

Figure 4:
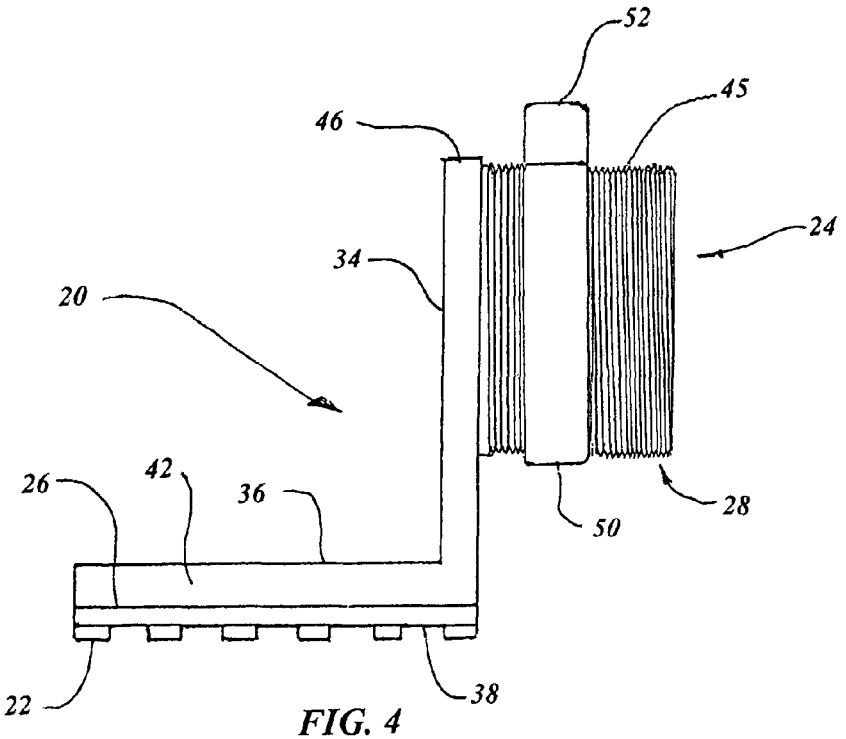
FIG. 4 is a right side view of the mount with the lockring attached.
Figure 5:
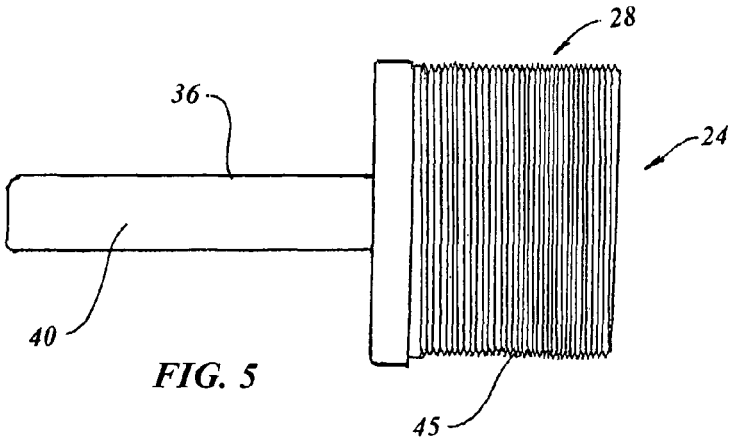
FIG. 5 is a top view of the mount in the preferred embodiment.
Figure 6:
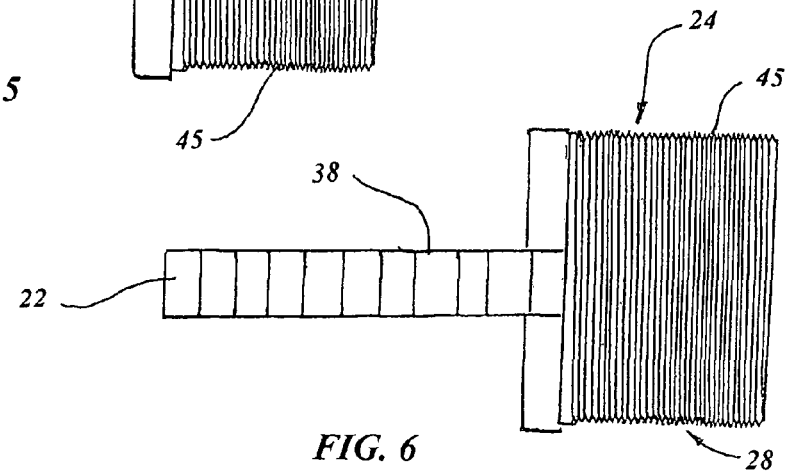
FIG. 6 is a bottom view of the mount in the preferred embodiment.
Figure 7:
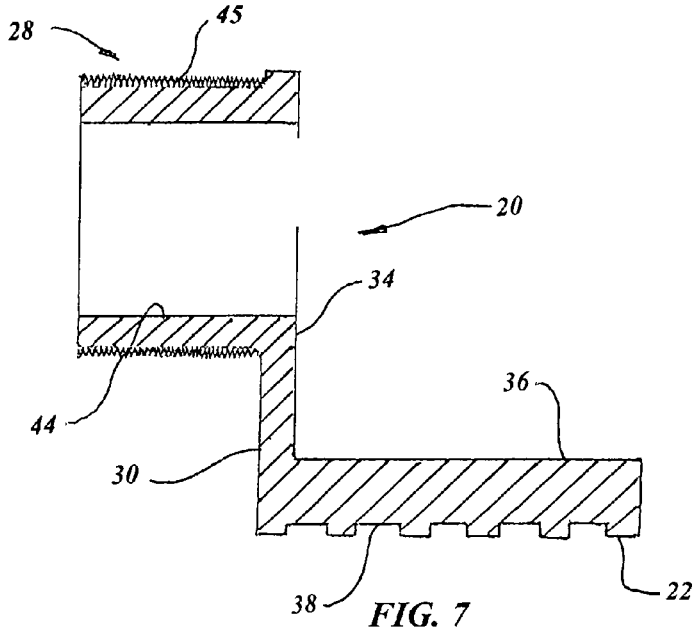
FIG. 7 is a cross sectional view taken along lines 7-7 of FIG. 2.
Figure 8:
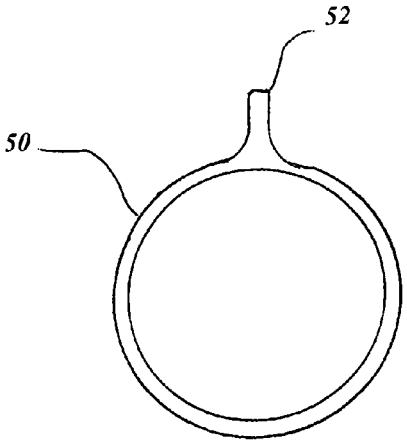
FIG. 8 is a front view of the lockring in the preferred embodiment.
Figure 9:
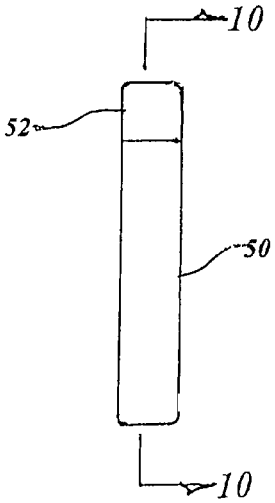
FIG. 9 is a left side view of the lockring in the preferred embodiment.
Figure 10:
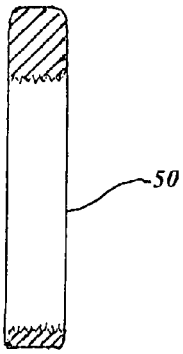
FIG. 10 is a cross sectional view taken along lines 10-10 of FIG. 9.

A lock ring 50, with a finger tab 52 for manual operation, is provided to fit onto the integral threaded handguard adapter portion 28 as illustrated assembled in FIG. 4 and unattached in FIGS. 8-10.

Figure 12:
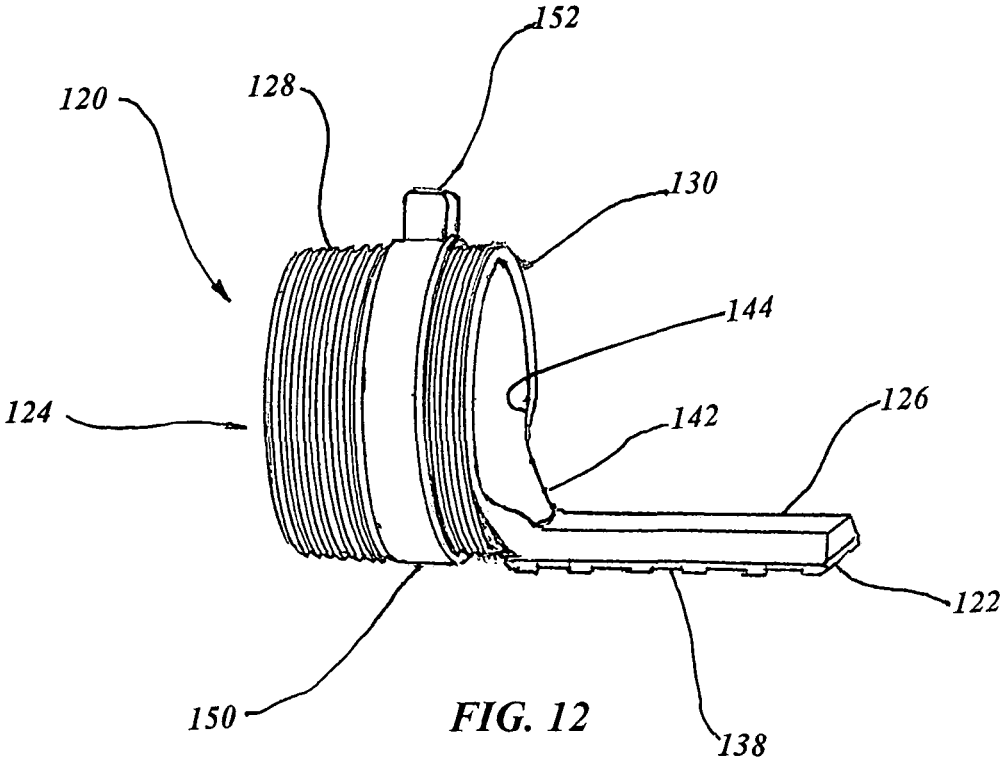
FIG. 12 is an isometric view of the mount in the second embodiment

The second embodiment, illustrated in FIG. 12, is basically the same as the preferred embodiment except it is simpler to make and lighter in weight by excluding features such as the vertical and horizontal legs, the extending portion of the legs and the distal end of the body.

The mount 120 incorporates an integral Picatinny rail 122 and a handguard interface 124. The mount 120 incorporates an integral Picatinny rail portion 126 for accessory mounting, and an integral threaded handguard adapter portion 128. The mount 120, is basically in an offset shape as illustrated in FIG. 12 and forms a body 130 with the integral threaded handguard adapter portion 128 protruding outwardly on a front side of the body 130 and the Picatinny rail portion 126 is formed integrally on the bottom of the body 130.

The mount body 130, includes integral threaded handguard adapter portion 128 and the integral Picatinny rail portion 126 conforms to Military Standard MIL-STD-1913 and has slots 138 that are spaced 0.394 inches center to center incorporating from 3 to 12 slots 138 in the rail 126.

The integral threaded handguard adapter portion 128 has a hollow inside diameter 144 adapted to conform to a rifle handguard internal surface and an outside threaded Picatinny rail portion 126 of a diameter from 0.25 inches to 6.50 inches. A riser 142 is configured as a radial transition from the round inside diameter 144 to the flat rail portion 126.

A lock ring 150, with a finger tab 152 for manual operation, is provided to fit onto the integral threaded handguard adapter portion 128.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

ADDENDUM

Handguard Extending Picatinny Rail Mount

Element Designation

Preferred Embodiment

20 mount with Picatinny rail
22 Picatinny rail
24 handguard interface
26 rail portion
28 integral threaded handguard adapter portion
30 body (of 20)
32 front side (of 30)
34 vertical leg (of 30)
36 horizontal leg (of 30)
38 slots (in 22)
40 longitudinal surface (of 36)
42 riser (on 36)
44 inside diameter (of 28)
45 threaded outside diameter (of 28)
45$_a$ threaded inside diameter (FIG. 11)
46 distal end (of 30)
48 extending portion (of 34)
50 lockring
52 finger tab (on 50)

Second Embodiment

120 mount with Picatinny rail
122 Picatinny rail
124 handguard interface
126 rail portion
128 integral threaded handguard adapter portion
130 body (of 120))
138 slots (in 122)
142 riser (126 to 144)

144 inside diameter (of 128)
150 lockring
152 finger tab (on 150)

The invention claimed is:

1. A mount with a Picatinny rail and a handguard interface which comprises:

said mount having an offset L-shape which includes an integral horizontal Picatinny rail portion for accessory mounting, an integral threaded handguard adapter portion for interfacing with an existing firearm free floating handguard and a lock ring.

2. A mount with a Picatinny rail and a handguard interface which comprises:

said mount having an offset L-shaped body, a vertical leg and a horizontal leg forming a Picatinny rail portion for accessory mounting, along with an integral threaded handguard adapter portion for interfacing with an existing firearm free floating handguard and a lock ring.

3. The mount with a Picatinny rail and a handguard interface as recited in claim 2 wherein said body having a front side, a distal end and an extending portion from the vertical leg.

4. The mount with a Picatinny rail and a handguard interface as recited in claim 2 wherein said body further having said integral threaded handguard adapter portion positioned on said body vertical leg opposite said Picatinny rail portion.

5. The mount with a Picatinny rail and a handguard interface as recited in claim 2 wherein said integral threaded handguard adapter portion has a length protruding from the body vertical leg from 0.25 inches to 2.00 inches.

6. The mount with a Picatinny rail and a handguard interface as recited in claim 2 wherein a vertical leg of said body having an extending portion from said threaded handguard adapter portion to said Picatinny rail portion from 0.25 inches to 6.50 inches.

7. The mount with a Picatinny rail and a handguard interface as recited in claim 2 wherein said mount further having said integral Picatinny rail portion positioned horizontally from said body vertical leg.

8. The mount with a Picatinny rail and a handguard interface as recited in claim 2 wherein said mount body consists of aircraft grade aluminum.

9. The mount with a Picatinny rail and a handguard interface as recited in claim 8 wherein said mount body of aircraft grade aluminum is hard anodized.

10. The mount with a Picatinny rail and a handguard interface as recited in claim 2 wherein said Picatinny rail portion is adapted to conform to Military Standard MIL-STD-1913.

11. The mount with a Picatinny rail and a handguard interface as recited in claim 2 wherein said Picatinny rail portion incorporates a plurality of slots consisting of at least 2 slots.

12. The mount with a Picatinny rail and a handguard interface as recited in claim 2 wherein said horizontal Picatinny rail portion having a riser with a width of from 0.60 inches to 0.65 inches (15.24 mm to 16.21 mm).

13. The mount with a Picatinny rail and a handguard interface as recited in claim 2 wherein said integral threaded handguard adapter portion having a hollow inside diameter adapted to conform to said free floating handguard interface surface.

14. The mount with a Picatinny rail and a handguard interface as recited in claim 2 wherein said integral threaded handguard adapter portion having an outside diameter of from 0.50 inches to 5.00 inches (12.7 mm to 127 mm).

15. The mount with a Picatinny rail and a handguard interface as recited in claim 2 further comprising said integral threaded handguard adapter portion having an inside diameter of from 0.50 inches to 5.00 inches (12.7 mm to 127 mm).

16. A mount with a Picatinny rail and a handguard interface which comprises:

said mount having an offset L-shaped body, a vertical leg and a horizontal leg forming a Picatinny rail portion for accessory mounting, along with an integral threaded handguard adapter portion for interfacing with an existing firearm free floating handguard, said mount further having an internal thread lock ring adapted to fit on said integral threaded handguard adapter portion, permitting rotation of 360 degrees thus placing the rail on the bottom, top sides or at any angle with said lock ring without tools.

17. The mount with a Picatinny rail and a handguard interface as recited in claim 16 wherein said lock ring has a finger tab for manual operation.

* * * * *